US010083789B2

(12) United States Patent
Hamberger

(10) Patent No.: US 10,083,789 B2
(45) Date of Patent: Sep. 25, 2018

(54) APPARATUS FOR REDUCING A MAGNETIC UNIDIRECTIONAL FLUX COMPONENT IN THE CORE OF A TRANSFORMER

(71) Applicant: Siemens Aktiengesellschaft, Munich (DE)

(72) Inventor: Peter Hamberger, Kirchschlag bei Linz (AT)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/890,383

(22) PCT Filed: May 28, 2013

(86) PCT No.: PCT/EP2013/060948
§ 371 (c)(1),
(2) Date: Nov. 10, 2015

(87) PCT Pub. No.: WO2014/191023
PCT Pub. Date: Dec. 4, 2014

(65) Prior Publication Data

US 2016/0125999 A1 May 5, 2016

(51) Int. Cl.
*H01F 27/28* (2006.01)
*H01F 27/38* (2006.01)
*H01F 27/42* (2006.01)

(52) U.S. Cl.
CPC ..... *H01F 27/28* (2013.01); *H01F 27/38* (2013.01); *H01F 27/42* (2013.01)

(58) Field of Classification Search
CPC ..... H01F 27/38
See application file for complete search history.

(56) References Cited

U.S. PATENT DOCUMENTS 2,050,082 A * 8/1936 Buell ..... H02J 3/24 307/102
4,058,761 A * 11/1977 Friedlander ..... H01F 27/34 323/206

(Continued)

FOREIGN PATENT DOCUMENTS

CN 101681716 3/2010
CN 202008919 U * 10/2011 ..... H01F 27/28

(Continued)

OTHER PUBLICATIONS

"Zigzag Grounding Transformers", Post Glover, pp. 1-2, 2010.

(Continued)

*Primary Examiner* — Elvin G Enad
*Assistant Examiner* — Malcolm Barnes
(74) *Attorney, Agent, or Firm* — Cozen O'Connor

(57) ABSTRACT

An apparatus for reducing a magnetic unidirectional flux component in the core of a transformer, i.e., a three-phase transformer, includes a plurality of compensation windings that are magnetically coupled to the core of the transformer, wherein a controllable current source for feeding current into the compensation windings is arranged electrically in series with the compensation windings, specifically with the neutral point thereof, which is forming by the inputs of the compensation windings, and a neutral earthing transformer is electrically connected to the outputs of the compensation windings, where the current source electrically interconnects the neutral point of the compensation windings and the neutral point of the neutral earthing transformer.

7 Claims, 2 Drawing Sheets

(56) References Cited

U.S. PATENT DOCUMENTS

| | | | | |
|---|---|---|---|---|
| 2007/0217103 | A1* | 9/2007 | AF Klercker Alakula | H01F 27/38<br>361/58 |
| 2007/0290670 | A1* | 12/2007 | Lee | H01F 30/12<br>323/361 |
| 2010/0194373 | A1* | 8/2010 | Hamberger | H01F 27/38<br>323/356 |

FOREIGN PATENT DOCUMENTS

| | | | | | |
|---|---|---|---|---|---|
| CN | 102364637 | | 2/2012 | | |
| CN | 102364637 | A * | 2/2012 | | H01F 27/30 |
| EP | 0309255 | | 3/1989 | | |
| JP | 59-13313 | | 1/1984 | | |
| JP | S5913313 | A * | 1/1984 | | H01F 27/34 |
| JP | 09-289125 | | 11/1997 | | |
| KR | 20060050624 | | 5/2006 | | |
| WO | WO 2012/041367 | | 4/2012 | | |
| WO | WO 2012/041368 | | 4/2012 | | |

OTHER PUBLICATIONS

Office Action dated Aug. 29, 2016 which issued in the corresponding Chinese Patent Application No. 201380076964.8.
Notice of Allowance dated Sep. 1, 2017 which issued in the corresponding Korean Patent Application No. 10-2015-7036639.

* cited by examiner

-- PRIOR ART --

APPARATUS FOR REDUCING A MAGNETIC UNIDIRECTIONAL FLUX COMPONENT IN THE CORE OF A TRANSFORMER

CROSS-REFERENCE TO RELATED APPLICATIONS

This is a U.S. national stage of application No. PCT/EP2013/060948 filed 28 May 2013.

BACKGROUND OF THE INVENTION

1. Field of the Invention

The invention relates to an apparatus for reducing a magnetic unidirectional flux component in the core of a transformer, i.e., a three-phase transformer, comprising a plurality of compensation windings that are magnetically coupled to the core of the transformer when used in transformers in the low voltage or medium voltage range and transformers of very high power (power transformers, high voltage direct current transmission transformers).

2. Description of the Related Art

In electrical transformers, as used in energy distribution networks, the situation may arise that direct current is fed into the primary winding or secondary winding which is undesirable. Such a direct current feed as (the DC-component) may, for example, originate from conventional electronic structural components presently in use when controlling electrical drives or even in reactive power compensation. A further cause may be geomagnetically induced currents (GIC).

Due to solar winds, the earth's magnetic field is altered and thus very low frequency voltages are induced on conductor loops on the earth's surface. With long electrical energy transmission lines the induced voltage may cause relatively large low frequency currents (quasi direct currents). Geomagnetically induced currents occur approximately in ten-year cycles. They are evenly distributed on all (three) phases, may reach up to 30 A per phase and may be discharged via the neutral point of a transformer. This leads to considerable saturation of the core of the transformer in a half-cycle and therefore to a high excitation current in a half-cycle. This additional excitation has a large harmonic component and as a result, via the stray field with the harmonic component, eddy current losses are produced in the windings and core components of the transformer. This may lead to local overheating in the transformer. Moreover, due to the high excitation requirement this leads to a high consumption of reactive power and a drop in voltage. Collectively, this may lead to instability of the energy transmission network. Put simply, the transformer behaves in a half-wave in the manner of a reactor.

Some energy transmission companies, therefore, already require in the specification of transformers 100 A direct current for the neutral point of the transformer.

As disclosed in WO 2012/041368 A1, use is made of an electrical voltage induced in a compensation winding and the electrical voltage is used for the compensation of the interfering magnetic unidirectional flux component by a thyristor switch being connected in series with a current limiting reactor, in order to introduce the compensation current into the compensation winding. This solution functions well for direct currents to be compensated in one range, where these direct currents are smaller by an order of magnitude than geomagnetically induced currents, i.e., approximately in the range below 10 A. For geomagnetically induced currents, the medium voltage level would have to be used, i.e., in the range of approximately 5 kV and high-powered thyristors used. Due to the high power loss of such thyristors this solution, however, is not economical.

A further solution for geomagnetically induced currents is represented by a "DC blocker" in which, in principle, a capacitor is connected to the neutral point of the transformer. This solution is problematic as a displacement voltage is produced by charging the capacitor. Moreover, the displacement voltage on the capacitor is limited so that it is generally not possible to block the entire direct current. A drawback with this solution is also when it results in a short circuit in the transmission network and therefore to zero currents.

SUMMARY OF THE INVENTION

In view of the foregoing, it is an object of the present invention to provide an apparatus for reducing a magnetic unidirectional flux component in the core of a transformer, where the apparatus, on the one hand, operates without the high power loss of powerful thyristors and, on the other hand, is not limited by a displacement voltage on a capacitor.

This and other objects and advantages are achieved in accordance with the invention by an apparatus in which a controllable current source is provided for feeding current into the compensation windings, where the controllable current source is arranged electrically in series with the compensation windings and specifically with the neutral point thereof, which is formed by the inputs of the compensation windings, a neutral earthing transformer is provided and is electrically conductively connected to the outputs of the compensation windings, and the current source electrically interconnects the neutral point of the compensation windings and the neutral point of the neutral earthing transformer.

The principle of the solution in accordance with the invention is once again based on direct current compensation via compensation windings, by current being fed specifically into the compensation windings, the effect thereof counteracting the unidirectional flux component and preventing the magnetizing of the core of the transformer. In other words, "counter ampere" turns are introduced into the transformer, where ampere turn is another term for the magnetic flux. In this case, the compensation current is introduced into the compensation windings by a controllable current source, where generally one compensation winding is provided for each phase of the transformer.

So that the compensation current may be introduced at low power, the problem of the voltages induced in the compensation windings has to be solved. This is implemented by a neutral earthing transformer, known per se, which is also denoted as a grounding transformer or earthing transformer. The neutral earthing transformer generates a neutral point relative to the phase-to-phase voltages of the compensation windings. As a result, the neutral point of the compensation windings and the neutral point formed by the neutral earthing transformer are at the same potential. Between these neutral points, a controllable current source may be therefore easily introduced. Moreover, the neutral earthing transformer has the advantage in that direct currents introduced via its neutral point and then uniformly distributed over all (three) of its arms, do not magnetize the core of the neutral earthing transformer.

In an embodiment of the invention, at least one current limiting reactor is electrically arranged in series with the current source. By connecting a current limiting reactor upstream, transient voltages may be effectively filtered out, so that they do not pass through the current source.

With the controllable current source, only the current that is required for the compensation of the undesired direct currents is supplied to the compensation windings. For determining the required compensation current, it may be provided that the controllable current source is connected to a measuring device for detecting the magnetic unidirectional flux component in the transformer. Such measuring devices are disclosed, for example, in WO 2012/041368 A1 in the form of a magnetic shunt component with a sensor coil. The shunt component may be arranged on the core of the transformer, such as, adjacent to an arm or the yoke, in order to conduct a portion of the magnetic flux in a bypass. From this magnetic flux conducted in the shunt, a sensor signal that has long-term stability may be very easily obtained via a sensor coil, where the signal after optional signal processing very clearly represents the unidirectional flux component (CD component).

The neutral earthing transformer may comprise windings in a zigzag arrangement for improved load distribution.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

For the further description of the invention reference is made in the following part of the description to the figures, further advantageous embodiments, details and developments of the invention being able to be derived therefrom, in which.

DETAILED DESCRIPTION OF THE EXEMPLARY EMBODIMENTS

Figure 1:
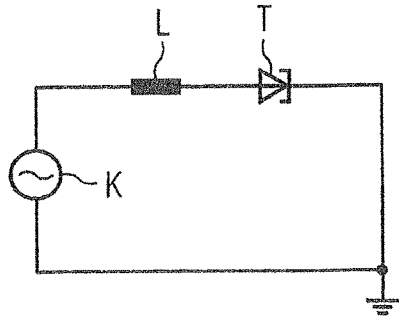
FIG. 1 shows a circuit in accordance with the prior art for introducing compensation current into a compensation winding comprising a thyristor circuit and FIG. 2 shows a circuit in accordance with the invention for introducing compensation current into compensation windings via a controllable current source.

With reference to the prior art in FIG. 1, in direct current compensation, direct current is introduced in a targeted manner into a compensation winding K to eliminate the direct current magnetizing of the transformer core. For introducing the required magnetic flux (i.e., direct current ampere turns) into the compensation winding K, use is made of the alternating voltage induced in the compensation winding K, and the compensation winding K functions as an alternating voltage source. On the compensation winding K, a switching unit T configured as a thyristor is connected in series with a current limiting reactor L. The required direct current may be adjusted by voltage-synchronous ignition at a specific ignition time of the thyristor T. If the thyristor is ignited in the voltage zero transition, the maximum direct current is set which, however, is superimposed by an alternating current having the amplitude of the direct current and the network frequency. If the thyristor T is ignited later, the direct current is smaller but harmonic alternating currents are also produced. The current path in the thyristor T is limited by a current limiting reactor L, and the permitted thermal load of the thyristor T is dimensioned for the current limit.

Figure 2:
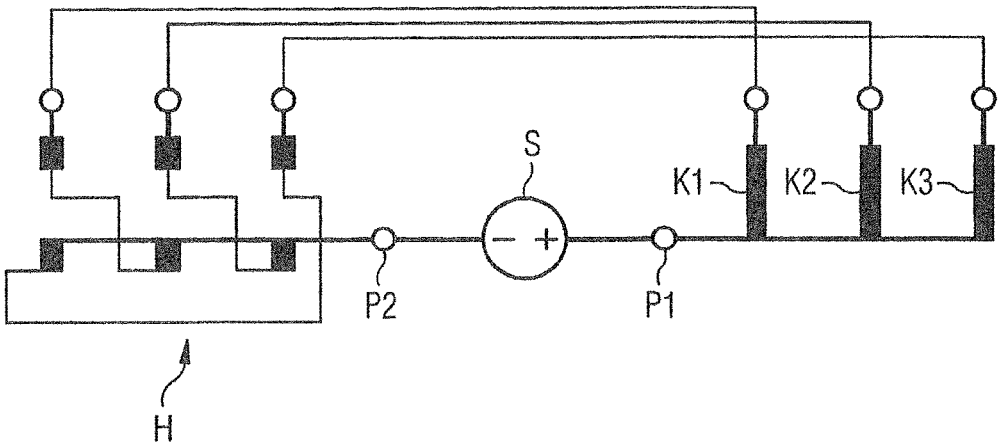
Figure 3:
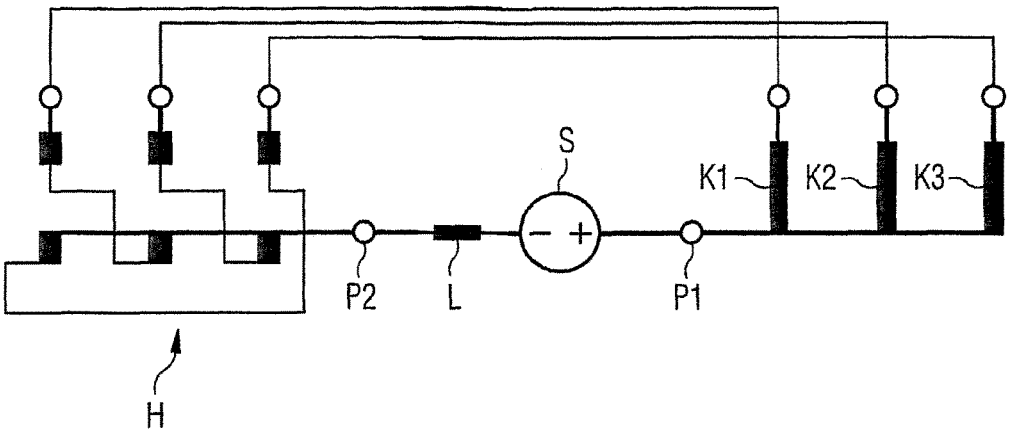
FIG. 3 shows a circuit in accordance with an embodiment of the invention for introducing compensation current into compensation winding via a controllable current source.

With reference to FIG. 2, a controllable current source S and a neutral earthing transformer H are used instead of the thyristor T, and in this disclosed embodiment in accordance with the invention also instead of the current limiting reactor L.

The controllable current source S is electrically directly connected in series with the compensation windings K1, K2, K3 and namely the inputs of the compensation windings K1, K2, K3 are connected together at a neutral point P1 that is directly connected to the current source S. One respective compensation winding K1, K2, K3 is arranged on an arm of a three-phase transformer (not shown).

In the neutral earthing transformer H, the three (the upper in this case) primary windings are each connected at their one terminal end to an output of a compensation winding K1, K2, K3. The other terminal ends are each connected at a terminal end of the three (the lower in this case) secondary windings in a zigzag arrangement. The other terminal ends of the secondary winding are brought together in an artificial neutral point P2 which is directly connected to the controllable current source S.

A zigzag arrangement means that the primary and secondary windings of a phase (in this case a compensation winding) are arranged on different arms of the neutral earthing transformer H and/or that the windings on the same arm belong to different phases (different compensation windings).

Primary and secondary windings of the neutral earthing transformer H are of the same size and, therefore, have approximately the same winding number but the current passes through them in different directions. Thus, with the same current in different windings, no flux is induced in the core of the neutral earthing transformer H.

The current source S is electrically connected, on the one hand, directly to the neutral point P1 of the compensation windings K1, K2, K3 and, on the other hand, to the neutral point P2 of the neutral earthing transformer H.

Similarly to FIG. 1, in FIG. 2 a current limiting reactor L could also be arranged electrically in series with the current source S.

By the method of the invention, large compensation currents and thus large demagnetizing turns may be introduced into the transformer at low power. The components at the medium voltage level that are used, such as the neutral earthing transformer H, are known per se and available. In turn, introduction of compensation windings with induced voltages at the medium voltage level represents proven technology. The advantage of the present invention is that the controllable current source is at earth potential. It is possible to reach 10 kV, 20 kV or 30 kV at the medium voltage level. At the same time, compensation direct current is reduced, and it is possible to use commercially available current sources. The neutral earthing transformer is very insensitive to direct currents at the neutral point as these are uniformly distributed and do not cause any additional magnetizing of the core.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An apparatus for reducing a magnetic unidirectional flux component in the core of a transformer, in particular a three-phase transformer, comprising:

a plurality of compensation windings which are magnetically coupled to a core of the transformer;

a controllable current source for feeding current into the plurality of compensation windings, said controllable current source being arranged electrically in series with the controllable plurality of compensation windings, and specifically with a neutral point thereof, which is formed by the inputs of the compensation windings; and a neutral earthing transformer electrically conductively connected to outputs of the plurality of compensation windings;

wherein the controllable current source electrically interconnects the neutral point of the compensation windings and the neutral point of the neutral earthing transformer.

2. The apparatus as claimed in claim 1, further comprising:

at least one current limiting reactor electrically arranged in series with the controllable current source.

3. The apparatus as claimed in claim 1, wherein the controllable current source is connected to a measuring device for detecting the magnetic unidirectional flux component.

4. The apparatus as claimed in claim 2, wherein the controllable current source is connected to a measuring device for detecting the magnetic unidirectional flux component.

5. The apparatus as claimed in claim 1, wherein one compensation winding, is provided for each phase of the transformer.

6. The apparatus as claimed in claim 1, wherein the neutral earthing transformer comprises windings in a zigzag arrangement.

7. The apparatus as claimed in claim 1, wherein the transformer is a three-phase transformer.

* * * * *